US006444631B1

(12) United States Patent
Ofosu-Asante et al.

(10) Patent No.: US 6,444,631 B1
(45) Date of Patent: Sep. 3, 2002

(54) DISHWASHING DETERGENT PRODUCT HAVING A ULTRAVIOLET LIGHT RESISTANT BOTTLE

(75) Inventors: Kofi Ofosu-Asante, Cincinnati, OH (US); Robert Henry Kordenbrock, Verona, KY (US); Robert Owens, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/647,969

(22) PCT Filed: Apr. 9, 1999

(86) PCT No.: PCT/US99/07827

§ 371 (c)(1),
(2), (4) Date: Oct. 6, 2000

(87) PCT Pub. No.: WO99/53008

PCT Pub. Date: Oct. 21, 1999

Related U.S. Application Data

(60) Provisional application No. 60/081,244, filed on Apr. 9, 1998.

(51) Int. Cl.[7] ..... C11D 1/14; C11D 1/72; C11D 3/30

(52) U.S. Cl. ..... 510/237; 510/235; 510/421; 510/422; 510/423; 510/426; 510/427; 510/428; 510/433; 510/499; 206/524.1

(58) Field of Search ..... 510/235, 237, 510/293, 421, 423, 422, 426, 427, 428, 433, 499; 206/524.1

(56) References Cited

U.S. PATENT DOCUMENTS

| | | | | | |
|---|---|---|---|---|---|
| 5,573,698 | A | * | 11/1996 | Mandler et al. | 510/277 |
| 6,159,918 | A | * | 12/2000 | Bae-Lee et al. | 510/293 |
| 6,369,025 | B1 | * | 4/2002 | Trinh et al. | 510/515 |

FOREIGN PATENT DOCUMENTS

| | | | |
|---|---|---|---|
| EP | 232092 A2 | | 8/1987 |
| GB | 1193780 | | 6/1970 |
| JP | 5124673 | | 5/1993 |
| JP | 08047979 | | 2/1996 |
| WO | WO 97/03170 | * | 1/1997 |
| WO | WO 97/20880 A1 | | 6/1997 |
| WO | WO 98/28393 A1 | | 7/1998 |
| WO | WO 99/11746 A1 | | 3/1999 |

* cited by examiner

*Primary Examiner*—Gregory Delcotto
(74) *Attorney, Agent, or Firm*—Kevin L. Waugh

(57) ABSTRACT

A dishwashing product containing a diamine-containing detergent composition specifically for hand dishwashing is disclosed. The container or bottle in which the detergent composition is contained is effectively resistant to UV light, thereby preventing any discoloration of the composition prior to full use of the product by the consumer. Alternatively, the composition itself is UV light resistant.

12 Claims, No Drawings

DISHWASHING DETERGENT PRODUCT HAVING A ULTRAVIOLET LIGHT RESISTANT BOTTLE

This application claims the benefit under 35 USC 119(e) of U.S. Provisional Application 60/081,244, filed Apr. 9, 1998.

FIELD OF THE INVENTION

The present invention relates to a dishwashing detergent product having a ultraviolet (UV) light resistant bottle in which a dishwashing composition is contained. More specifically, the invention is directed to a dishwashing detergent product for hand dishwashing which includes a UV light resistant bottle and a dishwashing composition containing a low molecular weight organic diamines that are especially effective on grease cleaning but susceptible to discoloration upon subject to UV light. The detergent composition of this invention can be in any form, including granular, paste, gel or liquid.

BACKGROUND OF THE INVENTION

Typical commercial hand dishwashing compositions incorporate divalent ions (Mg, Ca) to ensure adequate grease performance in soft water. However, the presence of divalent ions in formulas containing anionic, nonionic, or additional surfactants (e.g., alkyl dimethyl amine oxide, alkyl ethoxylate, alkanoyl glucose amide, alkyl betaines) leads to slower rates of product mixing with water (and hence poor flash foam), poor rinsing, and poor low temperature stability properties. Moreover, preparation of stable dishwashing detergents containing Ca/Mg is very difficult due to the precipitation issues associated with Ca and Mg as pH increases.

In the past, diacid salts of diamines have been employed in dishwashing detergent compositions. Under these conditions, these materials have several limitations, one of which is that the cleaning benefits are confined to relatively low hardness (<70 ppm) levels. The prior art also suggests use of a $C_2$ spacer, e.g., ethylene diamine diacid salt and ethoxylated diamines, both of which severely limit performance. It has been determined that the use of certain organic diamines, as outlined in detail below, with surfactants in dishcare compositions with pH's on the order of 8 to 12 (as measured at 10% solution) leads to improved cleaning of tough food stains and removal of grease/oil when compared to the use of Mg or Ca ions in conventional detergent compositions. Unexpectedly, these organic diamines also improve suds stability in the presence of soils, especially soils containing fatty acids and proteins. Further, the strong grease removal performance of the diamines discussed herein allows reduction/elimination of Mg/Ca ions from the formulation while maintaining benefits in grease performance. The removal of Mg/Ca additionally leads to improved benefits in dissolution, rinsing and low temperature product stability.

The diamines used in this invention in combination with surfactants also provide sensory benefits. It has been found that the presence of this composition produces a "silky" feel to wash liquor and a feeling of "mildness" to the skin. The diamines are also found to produce antibacterial benefits to the wash liquor. However, the specific compositions presented herein are especially designed for dishwashing having relatively high pH levels, detersive surfactants, and optional enzymes, all of which would be undesirable in contact lens cleaners. It has also been found these benefits are achieved through the use of low molecular weight organic diamines in higher pH formulations (8 to 12) across a broad range of hardness levels (8 to 1,000 ppm or higher).

One major problem, however, associated with dishwashing detergent compositions containing such diamines is that there is a tendency for such compositions to change color upon exposure to UV light, for example sunlight. Frequently, if not inevitably, dishwashing products will be subjected to UV light (e.g., sunlight) repeatedly and over extended periods of time prior to use by the consumer. The formulations of typical hand dishwashing products are specifically tailored to a color that has been proven to be aesthetically pleasing to consumers. Any change in the target formulation color, especially when clear or translucent bottle or other packaging container is used, can negatively impact the consumer's perception of the quality of the product, and moreover, in fact lead to lower cleaning performance resulting form an incidental degradation of the diamine active in the formulation. It would therefore be desirable to have a dishwashing product contain a diamine formulation which is not significantly altered by UV light.

Accordingly, despite the above-mentioned disclosures in the art, it would desirable to have a dishwashing product which has superior performance in addition to packaging appearance that is maintained until the consumer has disposed of the product. In that regard, a specific desirable feature would be to have such a dishwashing product which is not significantly altered upon exposure to UV light.

SUMMARY OF THE INVENTION

The invention meets the needs identified above by providing a dishwashing product containing a diamine-containing detergent composition specifically for hand dishwashing which has improved grease removal performance, sudsing benefits, improved low temperature stability properties, superior dissolution, as well as improved tough food stain removal and antibacterial properties. Most importantly, the container or bottle in which the aforementioned detergent composition is contained is effectively resistant to UV light, thereby preventing any discoloration of the composition prior to full use of the product by the consumer. Alternatively, the composition itself may contain a UV light blocker rather than the container.

In accordance with one aspect of the invention, an improved dishwashing detergent product is provided. The detergent product comprises an enclosed container in which a detergent composition is contained. The container has a reclosable opening through which the detergent composition can be dispensed. The container has walls containing an effective amount of an ultraviolet light blocker to substantially retard ultraviolet light from the detergent composition in the container. The detergent composition includes a) an effective amount of low molecular weight organic diamine having a pK1 and a pK2, wherein the pK1 and the pK2 of the diamine are both in the range of from about 8.0 to about 11.5; and b) an effective amount of detersive surfactant; wherein the pH is from about 8 to about 12.

Accordingly, the invention advantageously provides a dishwashing product having superior performance in addition to packaging appearance that is maintained until the consumer has disposed of the product. Also, the invention advantageously includes a specific desirable feature in that the dishwashing product is not significantly altered upon exposure to UV light.

All parts, percentages and ratios used herein are expressed as percent weight unless otherwise specified. All documents cited are, in relevant part, incorporated herein by reference.

DETAILED DESCRIPTION OF THE PREFERRED EMBODIMENTS

The invention essentially comprises a dishwashing detergent composition and a container which blocks, retards, or otherwise inhibits UV light such that the uniquely formulated detergent composition retains the target color. Heretofore, specially selected diamines were not formulated into dishwashing compositions as contemplated herein, and the problem of discoloration has not been recognized or addressed. The ordinary skilled formulator would have not predicted such a problem, nor recognized the solution as described herein. The container, which can be a bottle made of high density polyethylene or the like, includes a UV light blocker as described in detail hereinafter. As used herein, the phrase "UV blocker" means any material which is capable of blocking, reflecting, inhibiting a sufficient amount UV light to protect the detergent composition from deleterious effects of the UV light. The amount of UV light "blocking" will thus vary with the formulation of the dishwashing detergent composition in the container. The UV light blocker is preferably present in the container, or alternatively in the detergent composition itself, at an "effective amount" which will vary dramatically depending upon the size of the container. Typically amounts, which are based on the tear weight of the container, include from about 0.0001% to about 1% by weight, more preferably from about 0.0001% to about 0.8%, and most preferably from about 0.01% to about 0.4%. It is essential that the UV light blocker be adequately dispersed in the container walls such that UV light cannot penetrate the container and contact the detergent composition.

UV Light Blocker

One essential aspect of the invention involves the use of a UV light blocker which can be any material which fits the definition noted above. Exemplary UV light blockers suitable for use herein include those materials selected from the group consisting of benzotriazoles, orthohydroxy benzophenones, titanium dioxide, and mixtures thereof. The most preferred UV light blocker are substituted benzotriazoles. Specific substituted benzotriazoles for use herein are commercially available from Ciba Geigy under the tradename Tinuvin. A particularly preferred substituted benzotriazole (Tinuvin 326; Ciba Geigy) has the formula

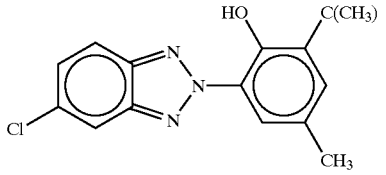

Yet another preferred substituted benzotriazole (Tinuvin P; Ciba Geigy) has the formula

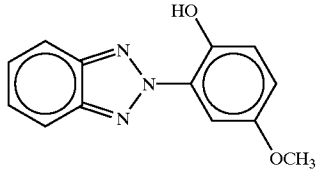

A preferred orthohydroxy benzophenone (Uvinul D49) has the formula

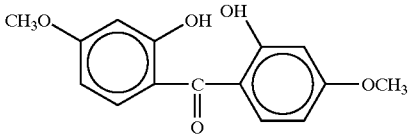

Yet another orthohydroxy benzophenone (Uvinul MS-40) has the formula

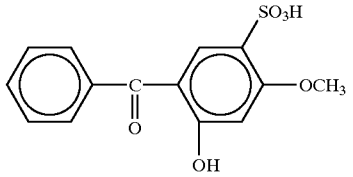

Diamine

Another essential aspect of the invention is to include an organic diamine in the detergent composition. When formulated into hand dishwashing detergents at a pH of above about 8, the diamines are more effective as replacements for the low-level use of Ca/Mg ions as surfactancy boosters long known in the dishwashing art. The diamines provide simultaneous benefits in grease cleaning, sudsing, dissolution and low temperature stability, without the shortcomings associated with Ca/Mg. The pH (as measured as a 10% aqueous solution) of the detergent composition is preferably from about 8 to about 12, preferably from about 8.2 to about 12, more preferably from about 8.5 to about 11; still more preferably from about 8.5 to about 10.8. The preferred weight ratios of surfactant to organic diamine range from about 40:1 to about 2:1 and most preferably from about 10:1 to about 5:1.

Furthermore, it is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation. Additionally, if amine oxide and/or other surfactants are present, the amine oxide or surfactant should be hydrogen peroxide-free. The preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide.

It is further preferred that the compositions of the present invention be "malodor" free. That is, that the odor of the headspace does not generate a negative olfactory response from the consumer. This can be achieved in many ways, including the use of perfumes to mask any undesirable odors, the use of stabilizers, such as antioxidants, chelants etc., and/or the use of diamines which are substantially free of impurities. It is believed, without wanting to being limited by theory, that it is the impurities present in the diamines that are the cause of most of the malodors in the compositions of the present invention. These impurities can form during the preparation and storage of the diamines. They can also form during the preparation and storage of the inventive composition. The use of stabilizers such as antioxidants and chelants inhibit and/or prevent the formation of these impurities in the composition from the time of preparation to ultimate use by the consumer and beyond. Hence, it is most preferred to remove, suppress and/or prevent the formation of these malodors by the addition of perfumes, stabilizers and/or the use of diamines which are substantially free from impurities.

The present detergent compositions comprise an "effective amount" or a "grease removal-improving amount" of individual components defined herein. By an "effective amount" of the diamines herein and adjunct ingredients herein is meant an amount which is sufficient to improve, either directionally or significantly at the 90% confidence level, the performance of the cleaning composition against at least some of the target soils and stains. Thus, in a composition whose targets include certain grease stains, the formulator will use sufficient diamine to at least directionally improve cleaning performance against such stains. Importantly, in a fully-formulated detergent the diamine can be used at levels which provide at least a directional improvement in cleaning performance over a wide variety of soils and stains, as will be seen from the examples presented hereinafter.

As noted, the diamines are used herein in detergent compositions in combination with detersive surfactants at levels which are effective for achieving at least a directional improvement in cleaning performance. In the context of a hand dishwashing composition, such "usage levels" can vary depending not only on the type and severity of the soils and stains, but also on the wash water temperature, the volume of wash water and the length of time the dishware is contacted with the wash water.

Since the habits and practices of the users of detergent compositions show considerable variation, it is satisfactory to include from about 0.25% to about 15%, preferably from about 0.5% to about 10%, more preferably from about 0.5% to about 6%, by weight, of the diamines in such compositions. In one of its several aspects, this invention provides a means for enhancing the removal of greasy/oily soils by combining the specific diamines of this invention with surfactants. Greasy/oily "everyday" soils are a mixture of triglycerides, lipids, complex polysaccharides, fatty acids, inorganic salts and proteinaceous matter.

Without being limited by theory, it is believed that the strong grease performance benefits achieved by the organic diamines across a broad range of hardness (up to about 1,000 ppm expressed as $CaCO_3$) reduces the need for divalent ions in the hand dishwashing detergent to bolster grease performance in soft water. Significantly, the removal of divalent ions from conventional hand dishwashing formulas leads to benefits in rate of product mixing with water (termed "dissolution"), flash foam, rinsing, and low temperature stability.

Depending on consumer preferences, the compositions herein may be formulated at viscosities of over about 50, preferably over about 100 centipoise, and more preferably from about 100 to about 400 centipoise. For European formulations, the compositions may be formulated at viscosities of up to about 800 centipoise. Moreover, the superior rate of dissolution achieved by divalent ion reduction even allows the formulator to make hand dishwashing detergents, especially compact formulations, at even significantly higher viscosities (e.g., 1,000 centipoise or higher) than conventional formulations while maintaining excellent dissolution and cleaning performance. This has significant potential advantages for making compact products with a higher viscosity while maintaining acceptable dissolution. By "compact" or "Ultra" is meant detergent formulations with reduced levels of water compared to conventional liquid detergents. The level of water is less than 50%, preferably less than 30% by weight of the detergent compositions. Said concentrated products provide advantages to the consumer, who has a product which can be used in lower amounts and to the producer, who has lower shipping costs. Superior grease cleaning and dissolution performance are obtained if the pH of the detergent is maintained in the range of about 8.0 to about 12. This pH range is selected to maximize the in-use content of non-protonated diamine (at one of the nitrogen atoms).

This is unlike the inferior situation that exists at pH less than 8 (see U.S. Pat. No. 4,556,509, Colgate) wherein the diamine is highly protonated and has little or no buffer capacity remaining or when using preformed amine salts or quaternized derivatives. Preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3 propane diamine (pK1=10.5; pK2=8.8), 1,6 hexane diamine (pK1=1; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2 —As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, N.Y. and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, N.Y., 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

The diamines useful herein can be defined by the following structure:

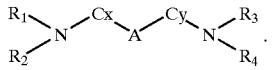

wherein $R_{1-4}$ are independently selected from H, methyl, —$CH_3CH_2$, and ethylene oxides; Cx and Cy are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater.

Examples of preferred diamines include the following:

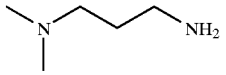

Dimethyl aminopropyl amine:

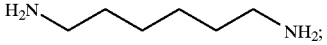

1,6-Hexane Diamine:

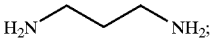

1,3 propane diamine-

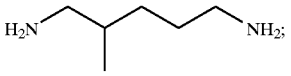

2-methyl 1,5 pentane diamine-

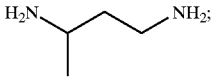

1-methyl-diaminopropane-

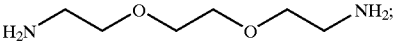

Jeffamine EDR 148-

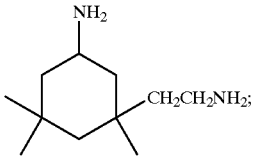

Isophorone diamine-

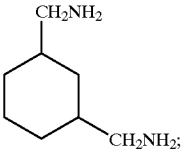

1,3-bis(methylamine)-cyclohexane and mixtures thereof.

When tested as approximately equimolar replacements for Ca/Mg in the near neutral pH range (7–8), the organic diamines provided only parity grease cleaning performance to Ca/Mg. This achievement is not possible through the use of Ca/Mg or through the use of organic diamines below pH 8 or through the use of organic diamine diacid salts below pH 8.

Optionally, the detergent compositions may further comprise a reduced level of Mg/Ca ions as compared to known conventional detergent compositions. To put it another way, the compositions herein preferably utilize no more than about 1.5%, more preferably no more than about 0.6%, of available divalent ions, preferably selected from calcium and magnesium. Most preferably, the detergent compositions herein are substantially free (i.e., less than about 0.1%) of added divalent ions.

The surfactants used in the detergent composition of the invention are selected from anionic, amphoteric, or nonionic surfactants or mixtures thereof. Preferred anionic surfactants for use herein include linear alkylbenzene sulfonate, alpha olefin sulfonate, paraffin sulfonates, methyl ester sulfonates, alkyl sulfates, alkyl alkoxy sulfates, alkyl sulfonates, alkyl alkoxylated sulfates, sarcosinates, alkyl alkoxy carboxylate, and taurinates. Preferred nonionic surfactants useful herein are selected from the group consisting of alkyl dialkyl amine oxide, alkyl ethoxylate, alkanoyl glucose amides, alkylpolyglucosides, alkyl betaines, and mixtures thereof. In one highly preferred embodiment, the anionic surfactants are selected from the group consisting of alkyl sulfates, alkyl alkoxy sulfates, and mixtures thereof. In another highly preferred embodiment, the amphteric surfactants are selected from the group consisting of amine oxide, alkyl betaine, and mixtures thereof. In yet another highly preferred embodiment the nonionic surfactants are selected from group consisting of alkanoyl glucose amides, alkyl polyglucosides, ethoxylated fatty alcohols and mixtures thereof. If a mixture of anionic surfactant and nonionic surfactant is used, the weight ratio of anionic:nonionic is preferably from about 50:1 to about 1:50, more preferably from about 50:1 to about 3:1. Also, when mixtures of anionic and nonionic surfactants are present, the hand dishwashing detergent composition herein preferably further comprise protease enzyme, amylase enzyme, or mixtures thereof. Further, these hand dishwashing detergent embodiments preferably further comprises a hydrotrope. Suitable hydrotropes include sodium, potassium, ammonium or water-soluble substituted ammonium salts of toluene sulfonic acid, naphthalene sulfonic acid, cumene sulfonic acid, xylene sulfonic acid.

The detergent composition may also comprise one or more detersive adjuncts selected from the following: soil release polymers, dispersants, polysaccharides, abrasives, bactericides, tarnish inhibitors, builders, enzymes, dyes, buffers, antifungal or mildew control agents, insect repellents, perfumes, hydrotropes, thickeners, processing aids, suds boosters, brighteners, anti-corrosive aids, stabilizers antioxidants and chelants. Although cationic surfactants may be optionally present in the detergent compositions herein, preferred embodiments are substantially free of cationic surfactant. Moreover, the compositions herein are substantially free of halide ions (chloride, fluoride, bromide, or iodide ions) and substantially free of urea. By "substantially free", it is meant less than about 1%, preferably less than about 0.1%, by weight of total composition, more preferably 0% added, of the specific component.

Moreover, the dishwashing detergent composition of this invention may also comprise enzymes preferably selected from the group consisting of protease, lipase, amylase, cellulase, and mixtures thereof; more preferably the enzymes are selected from protease and amylase. Formulating the compositions to be free of hydrogen peroxide is important when the compositions contain an enzyme. The peroxide can react with the enzyme and destroy any performance benefits the enzyme adds to the composition. Even small amounts of hydrogen peroxide can cause problems with enzyme containing formulations. However, the diamine can react with any peroxide present and act as an enzyme stabilizer and prevent the hydrogen peroxide from reacting with the enzyme. The only draw back of this stabilization of the enzymes by the diamine is that the nitrogen compounds produced are believed to cause the malodors which can be present in diamine containing compositions. Having the diamine act as an enzyme stabilizer also prevents the diamine from providing the benefits to the composition for which it was originally put in to perform, namely, grease cleaning, sudsing, dissolution and low temperature stability. Therefore, it is preferred to minimize the amount of hydrogen peroxide present as an impurity in the inventive compositions either by using components which are substantially free of hydrogen peroxide and/or by using non-diamine antioxidants even though the diamine can act as an enzyme stabilizer, because of the possible generation of malodorous compounds and the reduction in the amount of diamine available present to perform its primary role.

Moreover, the dishwashing detergent composition of this invention may include sodium bicarbonate, especially when formulated at a pH of below about 9. If present, the bicarbonate will comprise from about 0.5% to about 5%, preferably from about 1% to about 3%, by weight of the total composition.

The following examples are illustrative of the present invention, but are not meant to limit or otherwise define its scope. All parts, percentages and ratios used herein are expressed as percent weight unless otherwise specified.

In the following Examples all levels are quoted as % by weight of the composition.

EXAMPLE I

The following liquid dishwashing detergent compositions are made and packaged into a detergent container in the form of a high density polyethylene (HDPE) bottle including about 0.3% by weight of Tinuvin 326 commercially purchased from Ciba Geigy. The bottle is subjected to extended exposure to UV light (14 days), and unexpectedly, the detergent formulation retained its original color.

TABLE I

| | A | B | C | D | E |
|---|---|---|---|---|---|
| pH 10% | 9 | 10 | 10 | 9 | 10 |
| AS | 0 | 28 | 25 | 26 | 0 |
| AES | 30 | 0 | 0 | 7.2 | 29 |
| Amine Oxide* | 5 | 3 | 7 | 0 | 7.5 |
| Betaine | 3 | 0 | 1 | 0 | 0 |
| Polyhydroxy fatty acid amide (C14) | 0 | 1.5 | 0 | 0 | 0 |
| AE nonionic | 2 | 0 | 4 | 4.6 | 4.9 |
| Diamine | 1 | 5 | 7 | 1 | 5.6 |
| $Mg^{++}$ (as MgCl2) | 0.25 | 0 | 0 | 0.2 | 0 |
| Citrate (cit2K3) | 0.25 | 0 | 0 | 0 | 0 |
| Maleic Acid | 0 | 0 | 0 | 0 | 4.5 |
| Total (perfumes, dye, water, ethanol, etc.) | | | (to 100%) | | |

*contained about 0.7 ppm of residual hydrogen peroxide.

UV Light Testing

Samples of the following detergent compositions were made and packaged into detergent containers made from a high density polyethylene containing no UV blocker containing 0.3% UV blocker, Tinuvin 326. These containers were subjected to UV light for 14 days (to simulate about a year of exposure of the detergent compositions to UV light from the sun). After this period, any color change was read using Hunter Color Quest. Results of representative UV tests are shown in Table II below.

TABLE II

| Hunter Red | Fresh D | D in nil blocker container | D in container with 0.3% blocker |
|---|---|---|---|
| L | 99.35 | 98.87 | 99.52 |
| a | −0.87 | −0.70 | −0.62 |
| b | 3.31 | 5.36 | 2.55 |
| | L = 100 is white<br>a = + is red<br>b = + is yellow | L = 0 is black<br>a = − is green<br>b = − is blue | |

TABLE III

| Hunter Red | Fresh E | E in nil blocker container | E in container with 0.3% UV blocker |
|---|---|---|---|
| L | 99.30 | 98.67 | 99.25 |
| a | −1.56 | −1.44 | −1.09 |
| b | 4.74 | 7.58 | 4.32 |

Unexpectedly, the samples in the containers with UV blocker were not significantly different in color from the original or fresh sample detergent products, whereas the nil UV blocker products were discolored as a result of the prolonged UV light exposure.

| | F | G | H | I |
|---|---|---|---|---|
| pH 10% | 9.3 | 8.5 | 11 | 9 |
| AES | 0 | 15 | 10 | 26 |
| Paraffin Sulfonate | 20 | 0 | 0 | 0 |
| Linear Alkyl Benzene Sulfonate | 5 | 15 | 12 | 0 |
| Betaine | 3 | 1 | 0 | 8 |
| Polyhydroxy fatty acid amide (C12) | 3 | 0 | 1 | 0 |
| AE nonionic | 0 | 0 | 20 | 0 |
| DTPA | 0 | 0.2 | 0 | 4 |
| Citrate (as Cit2K3) | 0.7 | 0 | 0 | 1 |
| Diamine | 1 | 5 | 7 | 1 |
| $Mg^{++}$ (as MgCl2) | 1 | 0 | 0 | 0 |
| $Ca^{++}$ (as CaXS)2) | 0 | 0.5 | 0 | 0 |
| Protease | 0.01 | 0 | 0.05 | 0 |
| Amylase | 0 | 0.05 | 0.05 | 0 |
| Hydrotrope | 2 | 1.5 | 3 | 3 |
| UV blocker* | 0.6 | 0.6 | 0.6 | 0.6 |
| Total (perfumes, dye, water, ethanol, etc.) | | (to 100%) | | |

*Uvinul ® D49

The degree of ethoxylation in the AES ranges from 0.6 to about 3. The diamine is selected from: dimethyl aminopropyl amine; 1,6-hexane diamine; 1,3 propane diamine; 2-methyl 1,5 pentane diamine; 1,3-pentanediamine; 1-methyl-diaminopropane. The amylase is selected from: Termamyl®, Fungamyl®; Duramyl®; BAN®, and the amylases as described in W095/26397 and in co-pending application by Novo Nordisk PCT/DK/96/00056. The lipase is selected from: Amano-P; Ml Lipase®; Lipomax®; Lipolase®; and the Humicola lanuginosa strain DSM 4106.

The protease is selected from: Savinase®; Maxatase®; Maxacal®; Maxapem 15®; subtilisin BPN and BPN'; Protease B; Protease A; Protease D; Primase®; Durazym®; Opticlean®;and Optimase®; and Alcalase®. Hydrotropes are selected from sodium, potassium, ammonium or water-soluble substituted ammonium salts of toluene sulfonic acid, naphthalene sulfonic acid, cumene sulfonic acid, xylene sulfonic acid. DTPA is diethylenetriaminepentaacetate chelant.

Accordingly, having thus described the invention in detail, it will be obvious to those skilled in the art that various changes may be made without departing from the scope of the invention, and the invention is not to be considered limited to what is described in the specification.

What is claimed is:

1. A dishwashing detergent product comprising: an enclosed container in which a detergent composition is contained, said container having a reclosable opening through which said detergent composition can be dispensed, characterized in that said container has walls containing from about 0.0001% to about 1% by weight of the container of an ultraviolet light blocker selected from the group consisting of benzotriazoles, orthohydroxybenzophenones, titanium dioxide, and mixtures thereof to substantially retard ultraviolet light from said detergent composition in said container; said detergent composition comprising:

a) from about 0.25% to about 15% by weight of low molecular weight organic diamine having a pK1 and a pK2, wherein the pK1 and the pK2 of said diamine are both in the range of from 8.0 to 11.5; and b) an effective amount of detersive surfactant; wherein the pH of the detergent composition is from 8 to 12 and the weight ratio of said surfactant to said diamine is from about 40:1 to about 2:1.

2. The dishwashing detergent product according to claim 1 wherein said ultraviolet light blocker has the formula:

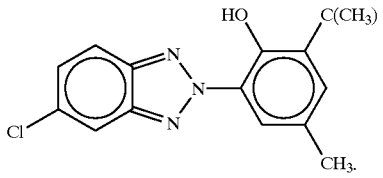

3. The dishwashing detergent product according to claim 1 wherein said ultraviolet light blocker has the formula:

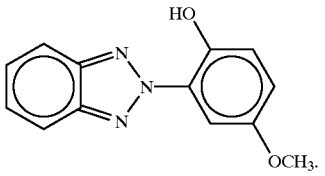

4. The dishwashing detergent product according to claim 1 wherein said ultraviolet light blocker has the formula:

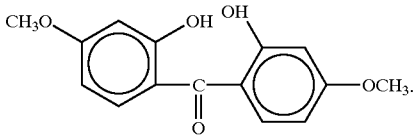

5. The dishwashing detergent product according to claim 1 wherein said ultraviolet light has the formula:

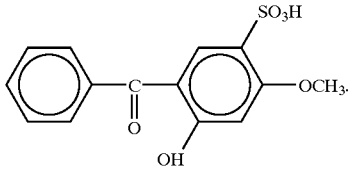

6. The dishwashing detergent product according to claim 1 wherein said detergent composition further comprises less than about 1.5% available divalent ions.

7. The dishwashing detergent product according to claim 1 wherein said diamine has the general formula:

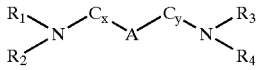

wherein $R_{1-4}$ are independently selected from H, methyl, ethyl, and ethylene oxides; Cx and Cy are independently selected from methylene groups or branched alkyl groups where x+y is from about 3 to about 6; and A is optionally present and is selected from electron donating or withdrawing moieties chosen to adjust the diamine pKa's to the desired range; wherein if A is present, then both x and y must be 2 or greater.

8. The dishwashing detergent product according to claim 14 wherein said diamine is selected from the group consisting of:

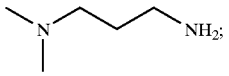

dimethyl aminopropyl amine- 1,6-hexane diamine-

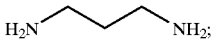

1,3 propane diamine-

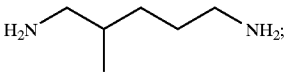

2-methyl 1,5 pentane diamine-

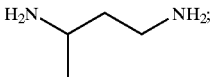

1-methyl-diaminopropane-

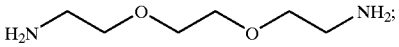

Jeffamine EDR 148-

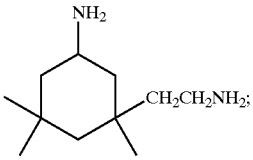

Isophorone diamine-

-continued

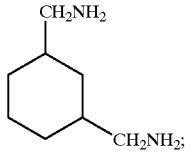

1,3-bis(methylamine)-cyclohexane and mixtures thereof.

9. The dishwashing detergent product according to claim 1 wherein said surfactant is an anionic surfactant selected from the group consisting of linear alkylbenzene sulfonate, alpha olefin sulfonate, paraffin sulfonates, methyl ester sulfonates, alkyl sulfates, alkyl alkoxy sulfate, alkyl sulfonates, alkyl alkoxylated sulfates, sarcosinates, taurinates, alkyl alkoxy carboxylate, and mixtures thereof.

10. The dishwashing detergent product according to claim 8 wherein said anionic surfactant is selected from the group consisting of alkyl sulfates, alkyl alkoxy sulfates, and mixtures thereof.

11. The dishwashing detergent product according to claim 1 wherein said surfactant is a nonionic surfactant selected from the group consisting of alkyl dialkyl amine oxide, alkyl ethoxylate, alkanoyl glucose amide, alkyl betaines, alkyl polyglucoside, and mixtures thereof.

12. The dishwashing detergent product according to claim 1 wherein said container is a bottle.

* * * * *